US011291316B2

(12) United States Patent
Levy

(10) Patent No.: US 11,291,316 B2
(45) Date of Patent: Apr. 5, 2022

(54) MESSAGING DEVICE

(71) Applicant: Marcos Antonio Levy, Skokie, IL (US)

(72) Inventor: Marcos Antonio Levy, Skokie, IL (US)

( * ) Notice: Subject to any disclaimer, the term of this patent is extended or adjusted under 35 U.S.C. 154(b) by 0 days.

(21) Appl. No.: 17/319,825

(22) Filed: May 13, 2021

(65) Prior Publication Data

US 2021/0378422 A1 Dec. 9, 2021

Related U.S. Application Data

(60) Provisional application No. 63/102,251, filed on Jun. 4, 2020.

(51) Int. Cl.

| | |
|---|---|
| ***A47G 1/06*** | (2006.01) |
| ***B42D 15/02*** | (2006.01) |
| ***A63F 9/04*** | (2006.01) |

(52) U.S. Cl.

CPC ..... *A47G 1/0622* (2013.01); *A63F 9/04* (2013.01); *B42D 15/027* (2013.01)

(58) Field of Classification Search

CPC ..... A63F 9/04; A63F 9/0495; A63F 9/0406; A63F 2009/0411; A63F 2009/0488; G09F 23/06; G09F 23/08

USPC ..... 273/145 R, 145 C, 161, 429, 430

See application file for complete search history.

(56) References Cited

U.S. PATENT DOCUMENTS

| | | | | |
|---|---|---|---|---|
| 183,157 | A * | 10/1876 | Haggerty | B43L 1/00 434/415 |
| 190,474 | A * | 5/1877 | Daniels | G09F 11/02 40/506 |
| 1,538,455 | A * | 5/1925 | Winkel | A63F 9/0406 273/145 C |
| 2,452,730 | A * | 11/1948 | Carter | A63F 9/0406 273/145 C |
| 3,119,621 | A * | 1/1964 | Bookman | A63F 9/0406 273/145 C |
| 5,100,141 | A * | 3/1992 | Fitch | A63F 9/0406 273/145 B |
| 7,694,967 | B2 * | 4/2010 | Denoual | A63F 9/04 273/145 A |
| D698,696 | S * | 2/2014 | McBurney | D11/157 |
| 2009/0263008 | A1 * | 10/2009 | Lai | G06K 9/00 382/154 |

FOREIGN PATENT DOCUMENTS

| | | | | |
|---|---|---|---|---|
| DE | 3538423 | A1 * | 5/1987 | A63F 9/0406 |

* cited by examiner

*Primary Examiner* — Cassandra Davis

(74) *Attorney, Agent, or Firm* — Fraline J. Allgaier

(57) ABSTRACT

A messaging device having an exterior surface and at least one messaging cube with a plurality of rotatable exposed faces is disclosed. The exterior surface is adapted to receive at least one viewable message and the plurality of light output messaging that is controlled by a remote control device. The plurality of rotatable exposed faces is adapted to receive at least one viewable message for attachment thereon.

7 Claims, 5 Drawing Sheets

MESSAGING DEVICE

RELATED APPLICATIONS

This application claims priority of U.S. Provisional Patent Application Ser. No. 63/102,251 filed Jun. 4, 2020.

FIELD OF THE INVENTION

The present invention refers to a messaging device including an exterior surface for light output messaging and a cover having an interior space and at least one messaging cube for displaying a plurality of viewable messages.

BACKGROUND OF THE INVENTION

The present invention provides a humorous way to tell a significant other that there is a problem in the relationship or just to tease. In a preferred embodiment, the device is a miniature dog house that lights up and displays the image of a dog or a cutout photo of a loved one, which takes "in the dog house" to a literal level.

Whether they're between girlfriends and boyfriends or husbands and wives, relationships can get stressful or tense, and one out of each pair often deserves the blame. To this end, the phrase "In the dog house" is being used with humor and in a manner to let the significant other know that he or she is peeved and that there needs to be a discussion about it. The invention as provided herein is an amusing conversation piece and enables couples or friends to tell each other that the relationship needs repair in a humorous manner. It is believed that this invention can help relieve tension, encourage communication, and further assist with the maintenance and improvement of relationships. It has become an imperative to provide innovative devices in settings such as homes, schools, hospitals, family gatherings, or similar environments where improved communication and relationship building is desired.

To this end, a messaging device comprising a cover having an interior space and an exterior surface capable of being viewed in a three dimensional perspective is disclosed. The messaging device is further characterized with the following novel features: (1) The interior space having at least one messaging cube with a plurality of exposed faces connected to a centrally positioned interior-connecting element; (2) the messaging cube is freely rotatable about the interior-connecting element and is thereby allowed to be selected and moved independently; (3) Each of the plurality of exposed faces is adapted to receive at least one viewable message; and (4) The exterior surface of the cover includes a plurality of light output messaging and wherein the plurality of light output messaging is controlled by a remote control device.

The invention will be described with reference to a messaging device including an exterior surface for light output messaging and an interior space having at least one messaging cube for displaying a plurality of viewable messages. Among other features, the light output messaging and viewable messages could be designed to correlate with the communication and relationship building assortment options associated with a plurality of information across a broad spectrum of interstate commerce.

BRIEF SUMMARY OF THE INVENTION

It is an advantage of the present invention to provide a messaging device including an exterior surface for a plurality of light output messaging and a cover having an interior space for displaying a plurality of viewable messages.

It is an additional advantage of the present invention to provide a messaging device having at least one messaging cube with a plurality of exposed faces being freely rotatable about an interior-connecting element and thereby allowing the plurality of exposed faces to be independently selectable and shiftable for the placement of at least one viewable message thereon.

It is an additional advantage of the present invention to provide a messaging device wherein the exterior surface includes a plurality of light output messaging and wherein the plurality light output messaging is controlled by a remote control device.

It is an additional advantage of the present invention to provide a messaging device wherein the plurality of exposed faces are adapted to receive a plurality of viewable messages thereon and the plurality of viewable messages being provided from a set of display messages in a predetermined pattern.

It is still an additional advantage of the present invention to provide a messaging device wherein a battery circuit is coupled thereon and wherein the battery circuit has connecting means for connecting the power source to multi-color LED lighting and the light output messaging being illuminated using the multi-color LED lighting.

It is still an additional advantage of the present invention to provide a messaging device having a remote control device including a user interface to produce a specific lighting sequence and wherein the remote control device is operatively connected to the messaging device and adapted for controlling the light output messaging.

It is still an additional advantage of the present invention to provide a messaging device wherein the messaging device is a scaled model of a doghouse.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

Additional advantages and features of the present invention will become more apparent when considered in light of the following specification and drawings.

BRIEF DESCRIPTION OF THE SEVERAL VIEWS OF THE DRAWINGS

The present embodiments are illustrated by way of the figures of the accompanying drawings, which may not necessarily be to scale, in which like references indicate similar elements, and in which.

DETAILED DESCRIPTION OF THE INVENTION

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

Figure 1:
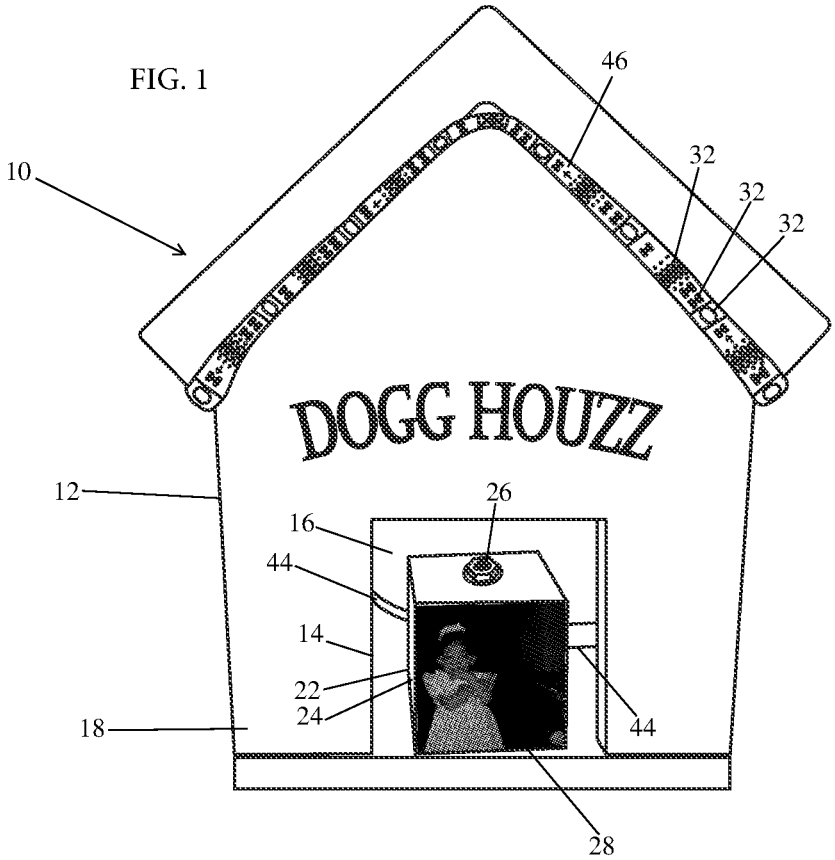
FIGS. 1-4 illustrate exemplary views of the messaging device showing the cover, messaging cube, viewable messages, and multi-color LED lights.
Figure 2:
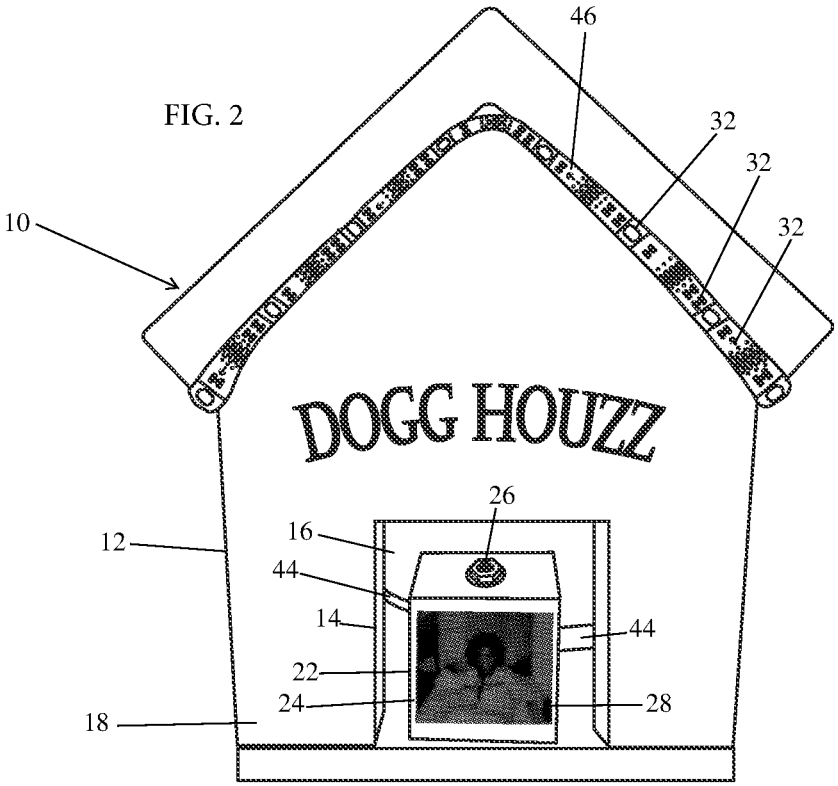
Figure 3:
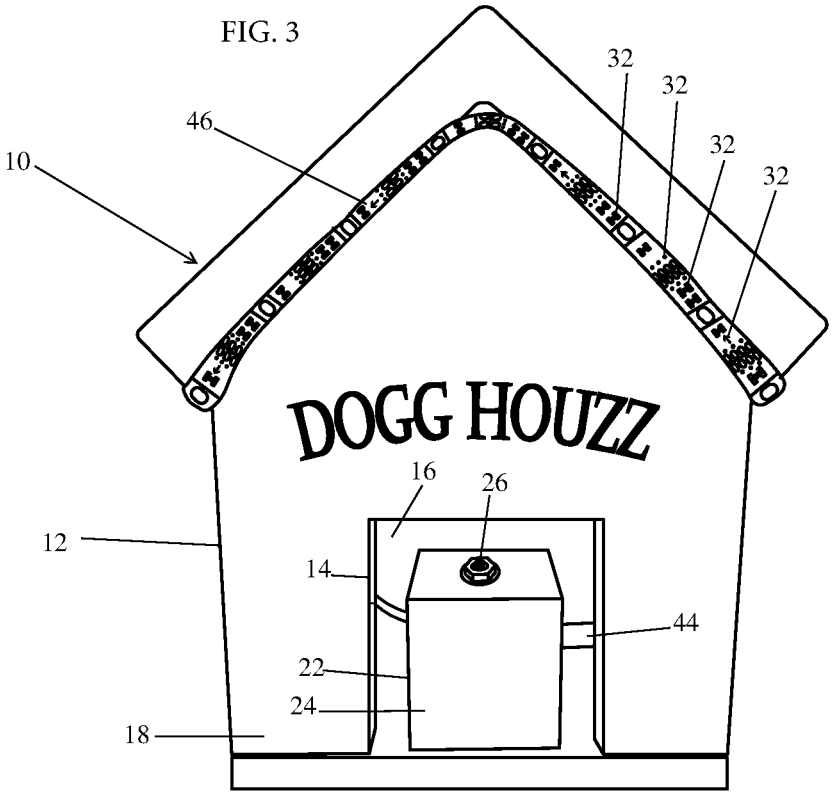
Figure 4:
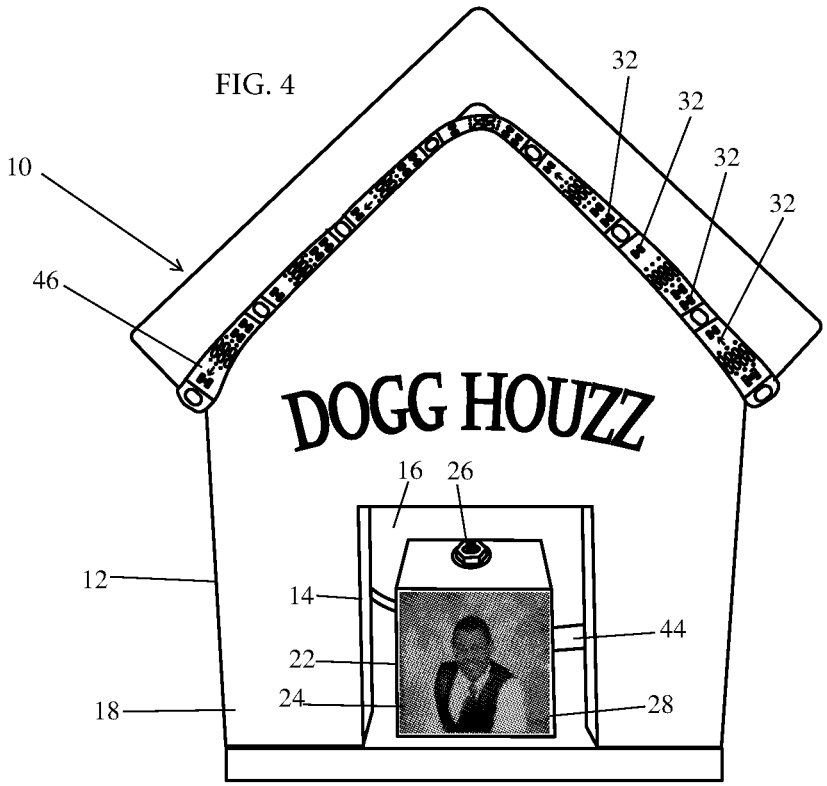
Figure 5:
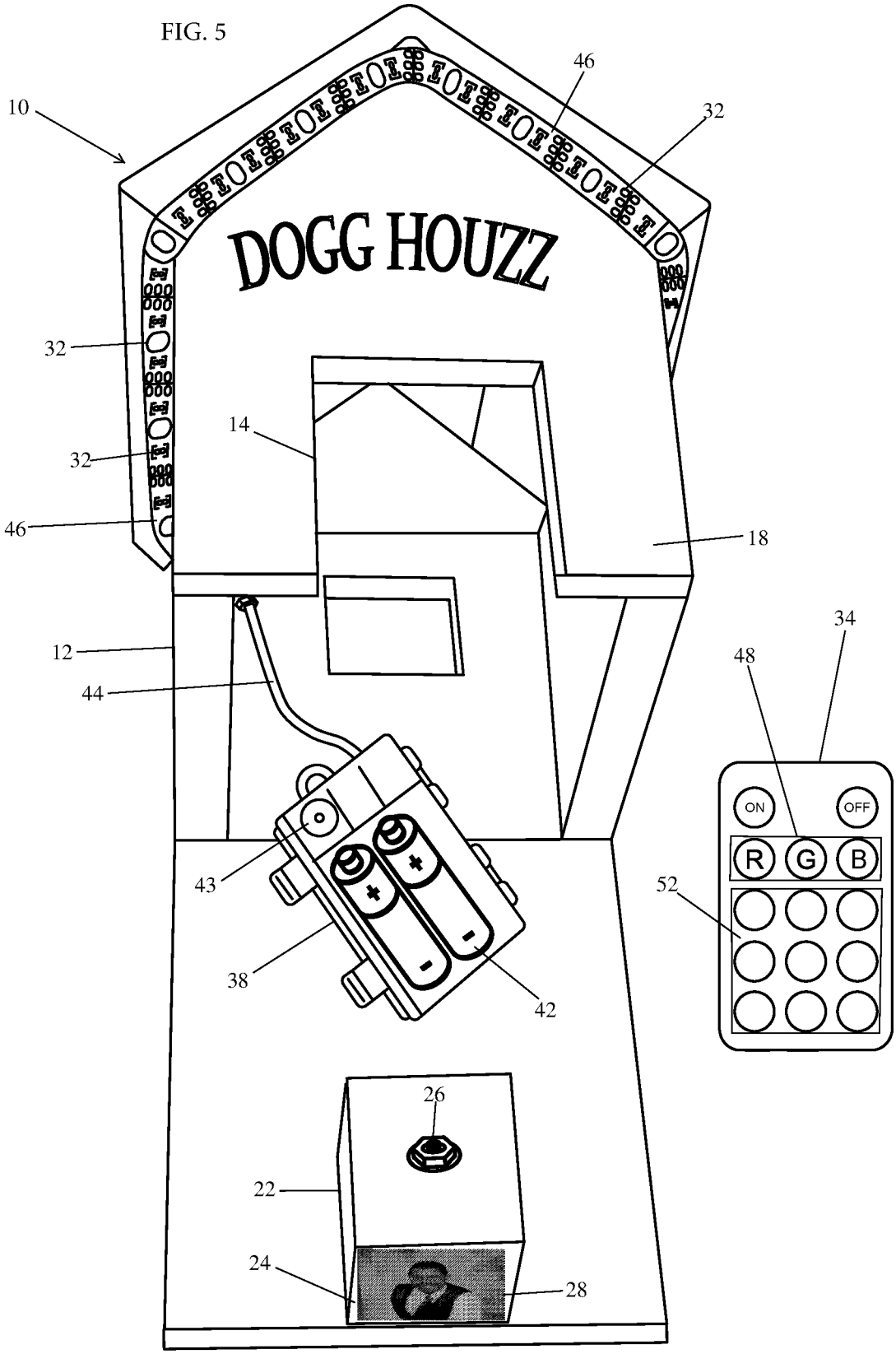
FIG. 5 illustrates an interior view of the messaging device in a partially opened position and in accordance with example embodiments.
Figure 6:
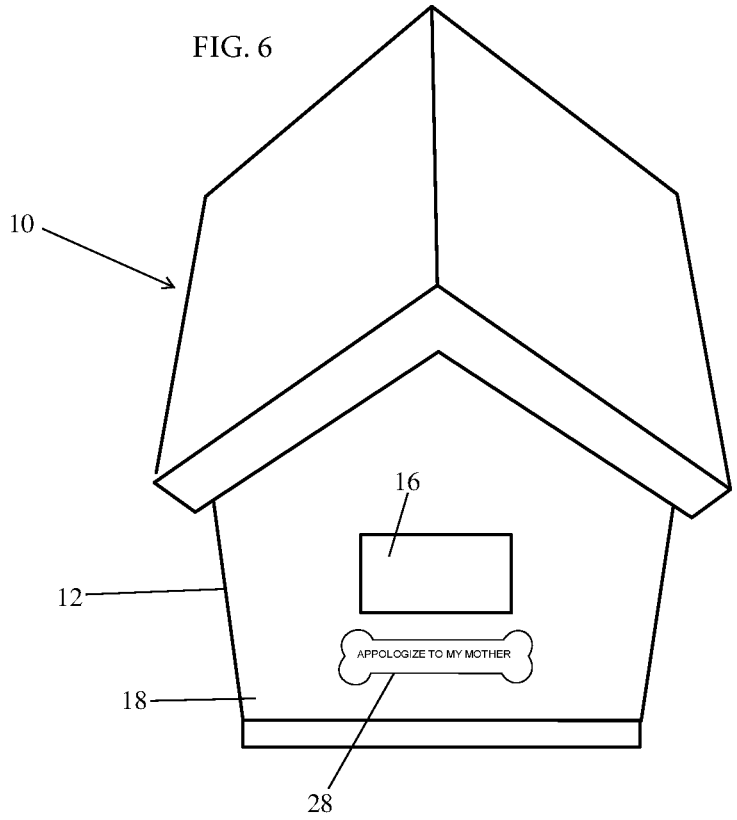
FIG. 6 illustrates an exemplary back view of the messaging device showing at least one viewable message being provided thereon.
Figure 7:
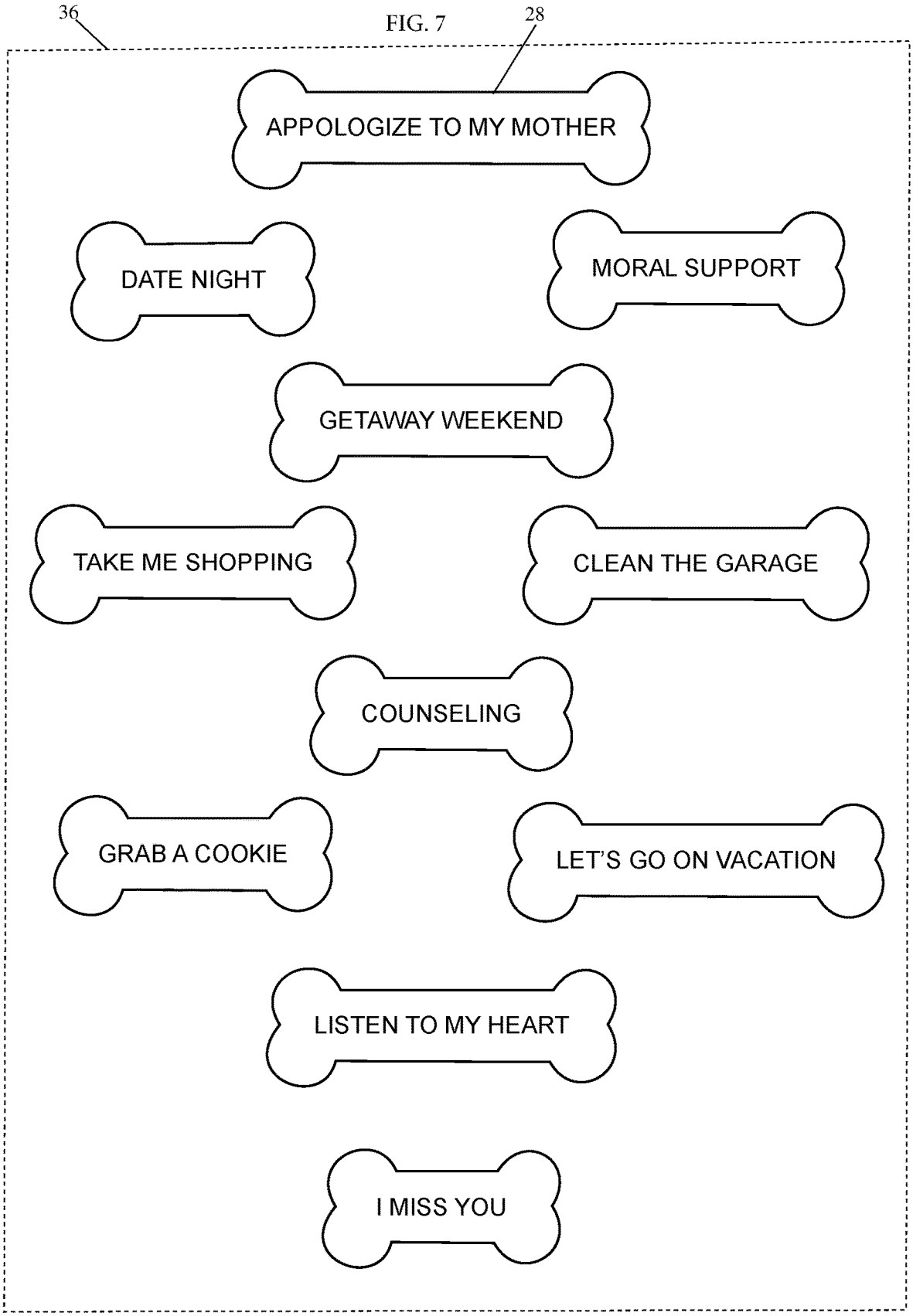
FIG. 7 illustrates an exemplary set of display messages in accordance with the preferred embodiments of the present invention.

Referring now to FIGS. 1-4, a messaging device 10 is disclosed. The messaging device 10 comprising a cover 12 including an opening 14 providing access to an interior space 16 and an exterior surface 18 capable of receiving a plurality of viewable messages 28 and of being viewed in a three dimensional perspective. The interior space 16 further having at least one messaging cube 22 with a plurality of exposed faces 24 connected to a centrally positioned interior-connecting element 26. The messaging cube 22 is freely rotatable about the interior-connecting element 26 and thereby allows the plurality of exposed faces 24 to be independently selectable and shiftable therefrom. The messaging cube 22 is inherently disposed for rotation around the interior-connecting element 26 shown in the drawings. The interior-connecting element 26 allows for the rotation of the messaging cube 22 in backwards or forwards directions. Because of the position of the hex-nut it is implied that the message cube includes a vertical axis. Therefore, the messaging cube 22 is inherently moveable because the hex nut is locked into place and fully coupled to the interior-connecting element 26. Each of the exposed faces 24 further having at least one viewable message 28 being attachable thereon and wherein the exterior surface 18 of the cover 12 features a plurality of light output messaging 32. The plurality of light output messaging 32 is controlled by a remote control device 34.

The messaging cube 22 is further characterized in that the plurality of exposed faces 24 are formed from a material that is adapted to receive the plurality of viewable messages 28 thereon. The viewable messages 28 are intended to be supplied with the messaging device 10 and applied perpendicularly for providing the intended sequence of messaging desired by a particular user. To that end, the plurality of viewable messages 28 is displayed on the plurality of exposed faces 24 from a set of display messages 36 in a predetermined pattern. The set of display messages 36 can include family photographs, colors, symbols, languages, or patterns that can be placed on the exposed faces 24 of the messaging cube 22. Groups of viewable messages 28 can be scrambled and then rearranged in predetermined patterns.

In a preferred embodiment, note cards can also be included with each messaging device 10, which would be used to encourage better communication for the offender in trouble as provided by the viewable message 28. Note cards can be created to be gender specific or gender neutral. Each note card can suggest a different behavioral act for the offender such as encouraging positive acts (flowers, dinner, fixing things around the house, etc.) as well asking the offender to seek outside advice, to spend quality time to listen to their partner, and reminders to the offender on the work it takes to maintain the relationship. Blank doggie treat note cards can also be included with the unit and would be filled out by the user if and when the offender improves their behavior. This can soften hearts in order to make communication more productive.

A battery circuit 38 is coupled to the messaging device 10 and the battery circuit 38 includes at least one battery 42 and an on/off switch 43 being connected thereon for switching on/off the messaging device 10. The battery circuit 38 has connecting means 44 for connecting the power source to multi-color LED lighting 46 and the remote control device 34 is used to select the intensity and color of the light output messaging 32 that is desired by a user.

The remote control device 34 features a user interface 48 including a keyboard 52 defined to produce a specific lighting sequence and wherein the remote control device 34 is operatively connected to the messaging device 10 and adapted for controlling the light output messaging, changes to the light output messaging, or any desired real-time light output messaging sequences. The user interface 48 of the remote control device 34 is pre-programmed to select the light output messaging 32 for the messaging device 10. The plurality of exposed faces 24 are therefore arranged so that the plurality of exposed faces 24 form a messaging pattern on the messaging cube 22. The messaging pattern being formed when at least one viewable message 28 is placed on at least one of the plurality of exposed faces 24 and at least one light output messaging 32 is provided on the exterior surface 18 of the messaging device 10.

In a preferred embodiment, the messaging device 10 is a scaled model of a doghouse that can be designed with a white exterior, a red roof that is produced from faux shingle, and two side windows. The multi-color LED lights 46 can be placed along the perimeter of the roofline. The dimensions of the base can be 6 inches×6 inches and the opposing and back walls are sufficiently sized to receive the plurality of viewable messages 28 thereon. The inventor prefers that the opening 14 is at least 3 inches and allows access to the messaging cube 22 that is preferably provided as a 2-inch cube. The messaging cube 22 is therefore a 2-inch×2-inch×2-inch cube with each surface thereof comprising a 2-inch×2-inch array of cubic elements. The plurality of exposed faces 24 are identically shaped and comprise an arrangement of 2-inch×2-inch arranged faces and wherein the viewable messages 28 can be seen by rotating the messaging cube 22 about the interior-connecting element 26.

The messaging device 10 is producible from high grade plastic. The messaging device 10 can have a size suitable for indoor or outdoor use and can be produced as a large-scale companion version with comparable advantages and features. It can be provided in a standard construction including the provisions for a plurality of durable materials. The portable messaging device 10 can be produced as a scaled model of a dog house as provided in the drawings or constructed as desired by a user or manufacturer. This can include shapes that are particularly interesting for children, schools, hospitals, or for users in a defined group. In addition, a plurality of additional elements such as trademarks, symbols, business identification, reflective indicia, product identifiers, holiday decorations, or instructional material can be applied and the messaging device 10 can be included into a plurality of relationship games, tests or devices. Depending upon the viewable messages 28 provided thereon, a plurality of items may be used with the messaging device 10 and the design selected by a user or manufacturer can be compatible therewith. For example, the viewable messages 28 can be constructed from paper, plastic, string, sponge, rubber, fabric, leather, wire, or any type of material that is capable of attachment to the messaging device 10.

An important attribute of the present invention is that is both inexpensive to produce and straightforward to dismantle for transportation. This invention will be mass-produced locally but can be readily available for use worldwide and in gifts shops, novelty stores, drug stores, mall kiosk, discount department stores, warehouse clubs and super stores, televised home shopping programs, websites, mail order catalogs, wholesalers of novelties, seminars, and conferences. Accordingly, an object of the present invention is to provide a relatively lightweight and portable messaging device 10 that is affordable, reliable, easily manufactured, and relatively inexpensive.

Having described my invention, however, many modifications thereto will become apparent to those skilled in the art to which it pertains without deviation from the spirit of the invention as defined by the scope of the appended claims. Although the invention has been explained in relation to its preferred embodiment, it is to be understood that many other possible modifications and variations can be made without departing from the spirit and scope of the invention.

What is claimed is:

1. A messaging device comprising a cover having an opening providing access to an interior space and an exterior surface capable of being viewed in a three dimensional perspective, the interior space further having a messaging cube with a plurality of exposed faces connected to a centrally positioned interior-connecting element, the messaging cube being freely rotatable about the interior-connecting element and thereby allowing the plurality of exposed faces to be independently selectable and shiftable therefrom, the plurality of exposed faces further having a viewable message being attachable thereon and wherein the exterior surface of the cover having a plurality of light output messaging and wherein the plurality of light output messaging is controlled by a remote control device, the messaging device further comprising:

the plurality of exposed faces receiving the viewable message and being formed from a material having connectivity for the viewable messages, the messaging cube being further characterized in that the plurality of exposed faces are formed from a material that is adapted to receive the viewable messages thereon and the viewable messages being displayed on the plurality of exposed faces from a set of display messages in a predetermined pattern, a battery circuit coupled to the messaging device and wherein the battery circuit having at least one battery and an on/off switch being connected to the battery circuit for switching on/off the messaging device, the on/off switch being mounted on the battery circuit, and wherein the battery circuit has connecting means for connecting the at least one battery to multi-color LED lighting having light intensity and color and the plurality of light output messaging being illuminated using the multi-color LED lighting and wherein the light intensity and color is adjustable, the remote control device having a user interface including a keyboard defined to produce a specific lighting sequence and wherein the remote control device being operatively connected to the messaging device and adapted for controlling the multi-color LED lighting and changes to the plurality of light output messaging, the messaging device being a scaled model of a doghouse.

2. The messaging device of claim 1 wherein the messaging device is produced as a larger companion version of the messaging device with equivalent effectiveness and features.

3. The messaging cube of claim 1 wherein the messaging cube is adapted to receive the viewable messages thereon.

4. The messaging cube of claim 1 wherein the messaging cube is of a 2-inch×2-inch×2-inch construction and is rotatably connected to the interior-connecting element.

5. The messaging device of claim 1 wherein the plurality of exposed faces of said messaging device are identically shaped and comprise an arrangement of 2-inch×2-inch plurality of exposed faces and wherein the viewable messages of said exposed faces can be realized by rotating the messaging cube about the interior-connecting element.

6. The messaging device of claim 1 wherein the user interface of the remote control is pre-programmed to select the plurality of light output messaging for the messaging device.

7. A messaging device comprising a cover having an opening providing access to an interior space and an exterior surface capable of being viewed in a three dimensional perspective, the interior space further having the messaging cube with a plurality of exposed faces connected to a centrally positioned interior-connecting element, the messaging cube being freely rotatable about the interior-connecting element and thereby allowing the plurality of exposed faces to be independently selectable and shiftable therefrom, the plurality of exposed faces further having at least one viewable message being attachable thereon and wherein the exterior surface of the cover having a plurality of light output messaging and wherein the plurality of light output messaging is controlled by a remote control device, wherein the plurality of exposed faces are arranged so that the plurality of exposed faces form a messaging pattern on the messaging cube, the messaging pattern being formed when at least one viewable message is placed on at least one of the plurality of exposed faces and at least one of the plurality of light output messaging is provided on the exterior surface of the messaging device.

* * * * *